US012760425B2

(12) United States Patent
McAnany et al.

(10) Patent No.: US 12,760,425 B2
(45) Date of Patent: Oct. 13, 2026

(54) GLASS ENAMELING OF ALUMINUM METAL MATRIX COMPOSITES

(71) Applicant: II-VI Delaware, Inc., Wilmington, DE (US)

(72) Inventors: Sean McAnany, Wilmington, DE (US); Samuel Salamone, Wilmington, DE (US); Michael Aghajanian, Wilmington, DE (US)

(73) Assignee: II-VI Delaware, Inc., Wilmington, DE (US)

( * ) Notice: Subject to any disclaimer, the term of this patent is extended or adjusted under 35 U.S.C. 154(b) by 193 days.

(21) Appl. No.: 18/478,578

(22) Filed: Sep. 29, 2023

(65) Prior Publication Data

US 2025/0333848 A1 Oct. 30, 2025

(51) Int. Cl.
*C23D 5/02* (2006.01)

(52) U.S. Cl.
CPC ..... *C23D 5/02* (2013.01)

(58) Field of Classification Search
CPC ..... C23D 5/00; C23C 28/321; C23C 28/345; C23C 22/08; C23C 14/562; C23C 18/1601; C23C 18/1662; C23C 18/1692; C23C 28/00; C23C 28/023; C23C 28/027; C23C 28/028; C23C 30/00; C23C 4/04; C23C 4/11; C23C 4/185; H04M 1/185
See application file for complete search history.

(56) References Cited

U.S. PATENT DOCUMENTS

| | | | | |
|---|---|---|---|---|
| 3,368,712 | A | 2/1968 | Sanford et al. | |
| 7,197,972 | B2 | 4/2007 | Aghajanian et al. | |
| 8,128,861 | B1 | 3/2012 | Aghajanian et al. | |
| 2015/0028333 | A1* | 1/2015 | Fujieda | H10F 77/12 438/85 |
| 2017/0260617 | A1 | 9/2017 | Lien | |
| 2018/0309469 | A1* | 10/2018 | Barbarossa | H04B 1/3888 |
| 2021/0188699 | A1 | 6/2021 | Yan et al. | |

FOREIGN PATENT DOCUMENTS

| | | |
|---|---|---|
| CN | 114437616 | 11/2022 |
| JP | S63247380 | 10/1988 |
| JP | H09291376 | 11/1997 |

OTHER PUBLICATIONS

Japanese Office Action Appln No. 2024-005799 dated Mar. 6, 2025.
European Office Communication with extended search report Appln No. 24165890.5 dated Oct. 11, 2024.

* cited by examiner

*Primary Examiner* — Alicia J Weydemeyer
(74) *Attorney, Agent, or Firm* — McAndrews, Held & Malloy, Ltd.

(57) ABSTRACT

A method of forming an enameled coating on a structure made of a metal matrix composite (MMC) material is provided. In some examples, the method includes providing a structure formed of the MMC material, the MMC material having a given coefficient of thermal expansion (CTE). An enamel mixture is formed to include a glass material and a pigment material, the material selected to yield a mixture with a substantially similar CTE. A surface of the MMC structure is coated with the enamel mixture, the structure then heated in order to melt the enamel mixture. Following the heat treatment, the heated, coated MMC structure is cooled, thereby achieving a glass enameled coating with a color corresponding to the selected pigment.

20 Claims, 5 Drawing Sheets

| Material Option | Mass | Stiffness | Ductility (Fracture Toughness) | Strength [UTS] | Hardness (Wear/Scratch Resistance) | CTE (lower preferred) | Thermal Conductivity | Cost |
|---|---|---|---|---|---|---|---|---|
| Stainless Steel [304, cast] | 8.00 g/cc | 193 GPa | 70 MPa-m$^{1/2}$ | 505 MPa | | 17 | 16 | |
| Aluminum [6061-T6] | 2.70 g/cc | 70 GPa | 29 MPa-m$^{1/2}$ | 310 MPa | [Addressed via Anodization] | 23 | 172 | |
| Magnesium [AZ91-T6] | 1.81 g/cc | 45 GPa | 20 MPa-m$^{1/2}$ | 240 MPa | | 26 | 73 | |
| Titanium [35A CP] | 4.52 g/cc | 106 GPa | 55 MPa-m$^{1/2}$ | 415 MPa | | 8 | 85 | |
| Al/SiC-55p MMC | 2.96 g/cc | 200 GPa | 13 MPa-m$^{1/2}$ | 320 MPa | | 11 | 160 | * |
| Al/$Al_2O_3$-50p MMC | 3.23 g/cc | 155 GPa | 20 MPa-m$^{1/2}$ | 445 MPa | | 14 | 70 | * |

FIG. 1

| Substrate | CTE (ppm) | Max Temperature (°C) |
|---|---|---|
| Substrate: 55% SiC/Al MMC | ~11 | 577 |
| Frit A | 9.3 | 500 |
| Frit B | 12.5 | 560 |
| Enamel Mixture: 33% A, 67% B | 11.4 | 540 |

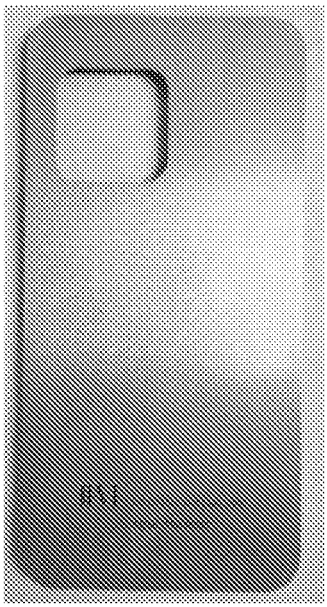
FIG. 5A
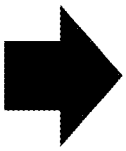
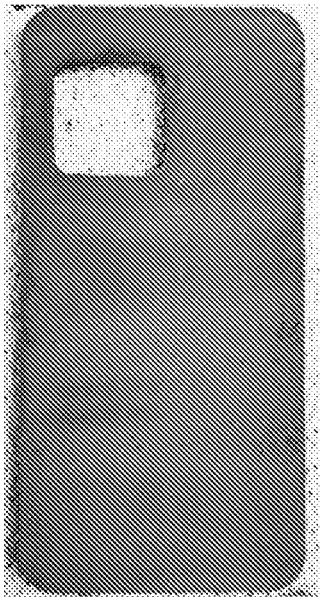
FIG. 5B

GLASS ENAMELING OF ALUMINUM METAL MATRIX COMPOSITES

BACKGROUND

Many types of electronic devices are portable, "hand held", mobile devices. In order to protect the electronics, communications and display components of such a device, an outer housing of the device (e.g., a chassis, a case, a shell, etc.) should be designed as rugged and resilient, as well as thin and lightweight.

Designing a housing that is attractive and durable, yet thin and lightweight, often results in compromise, such that one or more desirable characteristics falls short of expected performance. Thus, there is a need for a housing design that incorporates durability in a thin, lightweight, and aesthetically pleasing package.

The subject matter of the present disclosure is directed to avoiding the negative aspects of the problems set forth above.

SUMMARY OF THE DISCLOSURE

According to the present disclosure, a method of forming an enameled coating on a structure made of a metal matrix composite (MMC) material is provided. In some examples, the method includes providing a structure formed of the MMC material, the MMC material having a given coefficient of thermal expansion (CTE). An enamel mixture is formed to include a glass frit material and a pigment material, the material selected to yield a mixture with a substantially similar CTE. A surface of the MMC structure is coated with the enamel mixture, the structure then heated in order to melt and bond the enamel mixture. Following the heat treatment, the heated, coated MMC structure is cooled, thereby achieving a glass enameled coating with a color corresponding to the selected pigment.

The needs of conventional approaches are addressed by the present methods and devices, which relate to MMC structures (e.g., housings used for electronic devices) and, more particularly, to a component of the MMC structure coated with a glass enameled coating.

These and other features of the present disclosure will become more fully apparent from the following description and appended claims, as set forth hereinafter.

BRIEF DESCRIPTION OF THE DRAWINGS

To further clarify the above and other features of the present disclosure, a more particular description of the subject matter will be rendered by reference to specific examples thereof, which are illustrated in the appended drawings. It is appreciated that these drawings depict only some examples of the subject matter and are therefore not to be considered limiting of its scope.

FIG. 1 illustrates a table listing material options for electronic device housing applications, in accordance with aspects of the present disclosure.

FIG. 5A illustrates a MMC substrate with an exposed surface, and FIG. 5B illustrates the MMC substrate of FIG. 5A following application of an enamel mixture and thermal treatment, in accordance with aspects of the present disclosure.

The figures are not necessarily to scale. Where appropriate, similar or identical reference numbers are used to refer to similar or identical components.

DETAILED DESCRIPTION OF THE DISCLOSURE

Figures 2A, 2B, 2C, 2D, 2E:
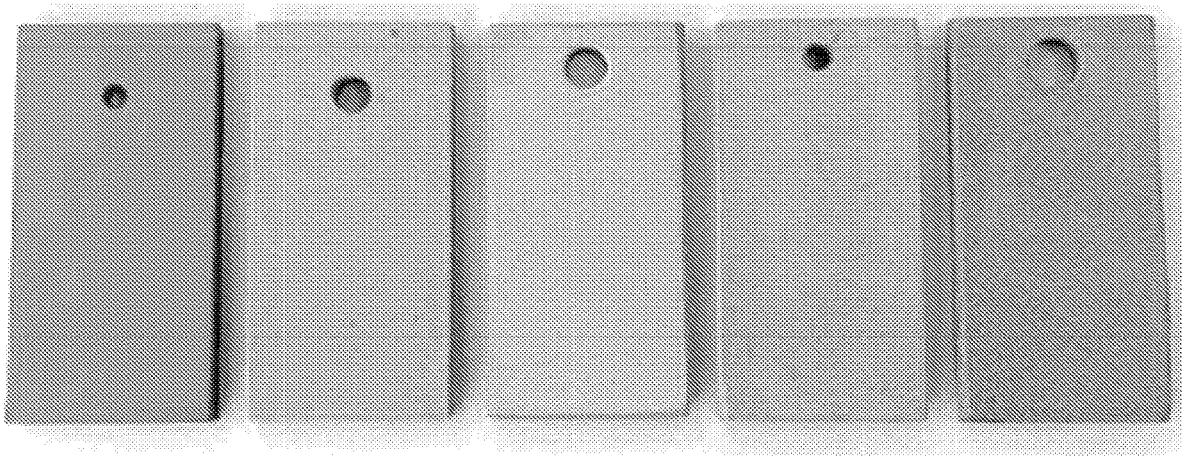
FIGS. 2A to 2E illustrate exemplary anodized substrates, in accordance with the present disclosure.

Methods for forming an enameled coating on a structure made from a metal matrix composite (MMC) material are provided.

Turning to FIG. 1, a table is illustrated listing several material options for electronic housing applications. As shown, light grey squares represent favorable values, black squares represent less favored values, with mid-grey squares representing middling values. The considered material options include stainless steel, aluminum, magnesium, titanium, Al/SiC-55p MMC, and $Al/Al_2O_3$-50p MMC. The material characteristics considered are mass of the material (g/cc), stiffness, ductility, strength, hardness (relative to other materials), CTE, thermal conductivity, and cost (relative to other materials).

It may be desirable to use MMC materials in consumer devices, for example, to limit bendability (e.g., increasing rigidity) of the frame, while remaining lightweight and thin. A measure of the stiffness of a material is provided by Young's modulus, which is measured in Pascal (Pa) or Newtons/$m^2$ (in higher orders of magnitude, defined as GigaPascal—GPa or kilo-Newton/$mm^2$). For purposes of the present disclosure, a Young's modulus on the order of 125 GPa provides a sufficiently stiff structural frame for device structures. Some example materials considered meet or exceed this standard, such as Al/SiC-55p MMCs. Al/SiC MMC materials exhibit a density similar to aluminum, but with an increased stiffness. Al/SiC materials can be formed using many different processes, such as but not limited to, die-casting, extrusion, forging, thixoforming, power metallurgy, and the like.

In some cases, a structural element (e.g., a frame) can be used to protect electrical contents of a consumer electronic device from mechanical damage (e.g., from bending, impact, etc.). Steel is an option for such a structural frame, as it exhibits a high stiffness. However, steel also has a high density, which leads to high component mass. Aluminum is also an attractive material, with a density significantly lower than steel. However, aluminum exhibits a low relative stiffness, which may lead to bending. For instance, bending electronic components can lead to catastrophic damage, such that preventing bending is a main goal of the structure.

Besides the needs for lightweight, durable structures, various consumer electronic devices (particularly, military devices) also derive benefits from a structure that provides the desired degree of stiffness/strength for a wide range of environmental factors, yet is lighter in weight than structures made of steel or other high-strength materials.

Titanium has attractive properties for similar chassis applications, however titanium had a higher relative cost. Stainless steel has high mass, which may be less attractive for small, portable devices. Aluminum and Magnesium both exhibit low stiffness values. Thus, MMCs provide a favorable combination of physical characteristics while being easily tailored for specific applications.

In some examples, Al/SiC has been used to illustrate results of the disclosed techniques and applications. As shown, Al/SiC has a relatively low mass, providing a desirable lightweight frame. Stiffness is relatively high, as is thermal conductivity, while CTE is relatively low. Despite challenges with relative ductility and strength, Al/SiC remains an attractive candidate material for such devices.

As noted in FIG. 1, $Al_2O_3$ material is less expensive than Al, which can reduce blending costs for MMCs. SiC particles are more expensive than Al, which can add to blended costs for MMCs. However, the favorable properties may make such materials a good choice for some applications.

As used herein, a metal matrix composite (MMC) is a material with at least two constituent parts—one being a metal and the other being a ceramic or organic compound (and/or a different type of metal). MMCs are made by dispersing a reinforcing material into a metal matrix. In some example MMCs, carbon fiber is used as the reinforcing material with an aluminum matrix, creating composites exhibiting low density and high strength. In another example, a MMC is made of aluminum (Al) impregnated with ceramic particles, such as silicon carbide, to form Al/SiC MMCs. In some examples, aluminum oxide may be used to form $Al/Al_2O_3$ MMCs. Depending on the metal (matrix) type, reinforcement chemistry, reinforcement shape (e.g., particles, fibers, whiskers, etc.) and the ratio between the two components, a range of useful properties can be engineered. Advantageously, properties/characteristics of MMCs can be tailored for a desired density, stiffness, ductility (elongation), strength, machinability, and/or thermal behavior.

A variety of different MMC materials may be used with the disclosed techniques, and the scope of the disclosure is not limited to any specific material, or class of materials. The metal matrix may be reinforced with any acceptable type of carbon fiber, ceramic fiber, or ceramic, where the type (and percentage) of reinforcement selected will result in an MMC with specific characteristics in terms of stiffness and strength.

In disclosed examples, MMC materials are described with a material content that includes a first metal material (e.g., aluminum, steel, titanium, magnesium alloys), and a second reinforcement material (e.g., SiC, $Al_2O_4$ and/or $B_4C$) present in a second amount (e.g., up to approximately 55%).

For consumer applications, such as portable electronic devices (e.g., mobile phones, tablets, etc.), it is desirable for MMC parts to be available in a variety of colors. Anodization techniques are relatively inexpensive and are capable of offering a variety of color finishes for aluminum, magnesium, or titanium materials. However, when used on MMC materials, anodization creates a dull, matte, and unappealing surface finish. Turning now to the drawings, FIGS. 2A to 2E illustrate some challenges in producing anodized structures. FIGS. 2A to 2E illustrate images representative of substrates (e.g., housings) of a variety of composition with anodization. However, each represents discontinuities in the application anodization. The figures represent an aluminum substrate 6061 Al; and MMC substrates Al/SiC-55p; $Al/Al_2O_3$-50p; $Al/Al_2O_3$-30p; and $Al/Al_2O_3$-25p; respectively.

In an example, anodizing a housing made of substantially pure Al yields a smooth red surface (e.g., represented in FIG. 2A). However, each of the MMC substrates develop a matte (e.g., rough, broken) finish. In some examples, the anodized layer grows at locations on the surface substantially exposing Al, but does not at location with other particle types. For instance, the Al/SiC example of FIG. 2B does not maintain color (e.g., turns gray), and the MMC substrates that include $Al/Al_2O_3$ do accept the color, but the color is less vibrant with increasing reinforcement concentration (which may be needed for durability and coating fidelity).

A challenge in enameling MMC materials is that the coefficient of thermal expansion (CTE) of the coating material (e.g., glass) should substantially match the CTE of the MMC substrate material. If a significant difference exists between CTEs of the coating materials and the MMC substrate materials, the coating tends to separate from the MMC substrate during cooling from the heat treatment, as contraction of the materials differs. To better match CTE between materials, two or more constituents (provided as frits) can be batched together to create an enamel mixture or slurry with a CTE that is equal to or substantially similar to that of the MMC substrate material.

Advantageously, the disclosed process can yield a structure with one or more colors, while enjoying the mechanical and thermal benefits of a MMC structure. In some instances, glass enameling can provide enhanced coloring and coating effects in comparison to other techniques (e.g., Anodization). For consumer applications such as electronic mobile devices, the ability to color parts of the structure in a wide range of colors can be appealing to manufacturers and customers.

To deliver a number of desirable characteristics on an MMC substrate, glass enameling can be applied to consumer products, such as a phone chassis. Chassis for cell phones are currently made from aluminum (Al), however MMCs offer an opportunity for creating lighter, thinner, and stronger chassis. One challenge to MMCs for this application is that, even as Al can be readily anodized to create products in many colors, anodization is not as effective for MMCs materials.

As explained above, the MMC housings exhibit a combination of the desired properties for a personal device frame, including low mass (similar to aluminum) and high stiffness (similar to steel). However, MMC materials with aluminum as a major component, reinforced with SiC or $Al_2O_3$ reinforcement content, offers challenges to maintaining a consistent and appealing coating. While some example MMC material housings are illustrated and described as a single rectangle, various other geometries and/or topologies for MMC material structural elements may be utilized for application seeking to increase the rigidity and/or strength of the structure (useful for industrial or military applications, for example).

Figure 3A:
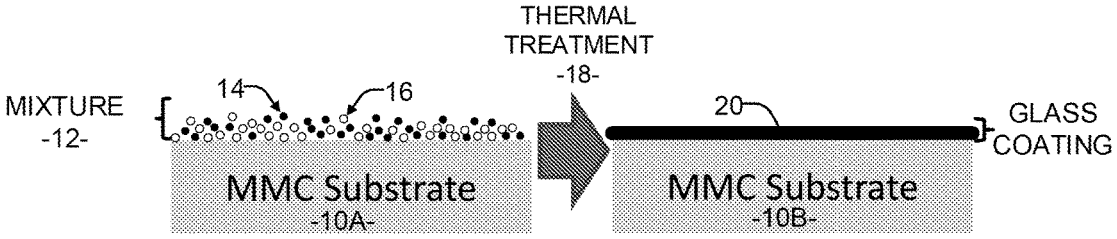
FIG. 3A illustrates an example glass enameling technique applied to a MMC substrate, in accordance with aspects of the present disclosure.

FIG. 3A illustrates an example glass enameling technique applied to MMC substrates, as disclosed herein. As shown in FIG. 3A, an enamel mixture/slurry of glass powder 12 applied to a surface of a MMC substrate 10A. The slurry 12 includes a mixture consisting of one or more frits, such as pigment frits 14 and glass frits 16. As shown, the MMC substrate 10A is coated with the slurry 12 and heated by thermal treatment 18 to melt the frit(s), creating a glass coating 20 on MMC substrate 10B. Although two material types are shown in the example of FIG. 3A, three, four, five, six, seven, eight, nine, ten or more material types may be included in the slurry (e.g., as frits).

In some examples, the slurry 12 can be designed to produce a clear or translucent coating after firing (e.g., thermal treatment 18). In this manner, the slurry 12 may include glass material frits 16, or a combination of glass materials, such that a resulting glass coating 20 is substantially clear, while providing a protective layer over the MMC substrate 10B. If so desired, however, pigment frits 14 can be added to the slurry 12, thereby producing a colored coating. In an example, an amount of red pigment (e.g., approximately 10% by weight of the slurry) was added to the mixture as pigment frits 14, thereby creating a red glass coating 20.

In some examples, two or more different glass frits 16 without pigment are used (e.g., to form the glass material). A benefit of using two or more different glass frits is the ability to select glass frits with different CTE values that, collectively, approximate a desired CTE and firing temperature for use with a selected substrate. For instance, some frits may be are sold with a description of their CTE and firing temperature (with values shown in example FIG. 4A). However, each frit may have different chemical compositions to achieve these properties. Thus, combining frits with different properties may yield the desired effect, including incorporation of a pigment, as disclosed herein.

Figure 3B:
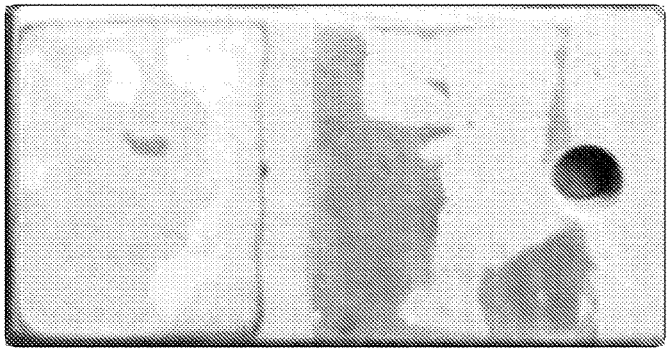
FIG. 3B illustrates an example MMC substrate with a glass enameled coating in which CTE is not matched between the MMC and the glass enameled coating, in accordance with aspects of the present disclosure.

However, as explained herein, combining pigments with the glass enameling materials can result in a cracked and delaminated coating, if the CTE is not matched between the enameling materials and the MMC substrate. As shown in the example of FIG. 3B, color can be unevenly distributed across a surface of a MMC frame, showing crack lines and a poorly bonded coating.

As disclosed herein, delamination can occur during cooling if the materials used in the enamel mixture have a CTE that does not substantially match a CTE of the MMC substrate. As provided, CTE of the mixture of frits can be tailored by mixing together one or more frits, even using different frits with different CTEs.

During an enameling process the coated MMC is fired at a specific temperature designed to melt the frits, thereby allowing the coating materials to adhere to the MMC substrate. This temperature is selected to be below the solidus temperature of the MMC substrate material (for example, an alloy) to avoid melting the MMC material.

In example MMC substrates formed of a SiC-reinforced Al alloy, high Si content in the alloy sets the solidus temperature at about 577 degrees C., which may be lower than that of typical Al alloys. Therefore, the frits must be chosen to create an enamel mixture with a firing temperature below that the solidus temperature of the SiC-reinforced Al alloy.

As disclosed herein, a coating can be applied to one or more surfaces of the structure treated with MMC enameling techniques by 1) applying an enamel mixture or slurry (e.g., containing glass frit and pigment) to a surface of the structure, and 2) heat treating (e.g., firing) the structure in a furnace.

Figures 4A, 4B, 4C:
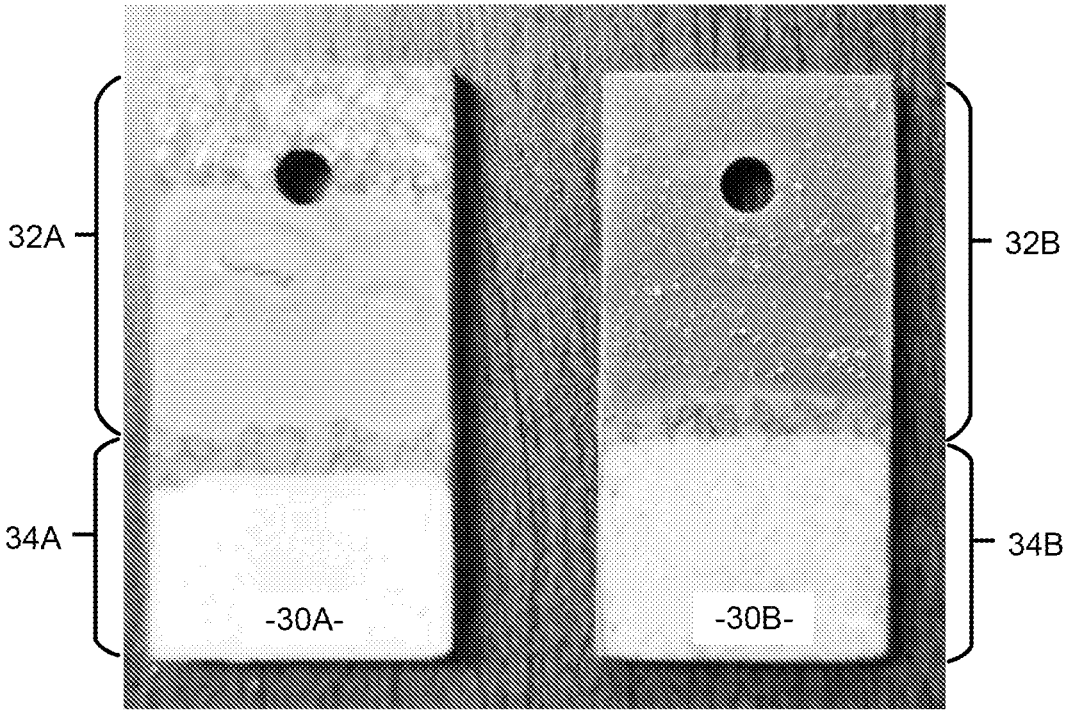
FIG. 4A provides a table for an example enamel mixture composition for glass enameling of a MMC substrate, in accordance with aspects of the present disclosure.
FIGS. 4B and 4C show examples of MMC housings with enameled coatings, in accordance with aspects of the present disclosure.

FIG. 4A provides a table for an example enamel mixture composition for glass enameling of a MMC substrate, as disclosed herein. As shown, a MMC substrate is provided with a content of SiC/Al of approximately 55%. The MMC substrate has a CTE of approximately 11, and a maximum temperature of approximately 577 degrees C.

An enamel mixture comprises of frits A and B, with a concentration of approximately 33% and 67%, respectively. Frit A corresponds to a CTE of approximately 9.3 and a firing temperature of approximately 500, whereas frit B corresponds to a CTE of approximately 12.5 and a firing temperature of approximately 560. When combined in the enamel mixture in the illustrated percentages, the resulting CTE is approximately 11.4 and a firing temperature of approximately 540.

As explained herein, there is substantial similarity between CTE of the substrate and the frit mixture. For example, the frit mixture CTE is within a threshold difference (less than 5%, but can be less than 1%, 10%, 15%, 20%, or any other amount to achieve a desired result). Additionally, firing temperature of the frit mixture is below the maximum temperature of the MMC substrate.

FIGS. 4B and 4C show examples of MMC housings 30A and 30B with enameled coatings, as disclosed herein. The MMC housings are each Al alloys with SiC components. As shown, the MMC housing 30A of FIG. 4A has a top portion 32A and a lower portion 34A, the top portion 32A being treated with a glass enamel mixture with 10% pigment, and the lower portion 34A without pigment. The MMC housing 30B of FIG. 4C has a top portion 32B and a lower portion 34B, the top portion 32B being treated with a glass enamel mixture with 10% pigment, and the lower portion 34B without pigment.

The difference in finishes between FIGS. 4B and 4C stems from thermal treatment times. As provided, the MMC housing 30A was treated for a relatively short amount of time (e.g., five minutes) in a particular treatment environment (e.g., ambient air). The MMC housing 30B was treated for a relatively longer amount of time (e.g., 20 minutes) in a similar treatment environment. The relatively dark appearance of the top portion 32B of the MMC housing 30B represents deeper coloring versus the top portion 32A of the MMC housing 30A. This is a result of the extended thermal treatment time for MMC housing 30B, which allowed more time for melting of the enamel mixture, creating a richer color.

FIG. 5A illustrates a MMC substrate with an exposed surface. FIG. 5B illustrates the MMC substrate following application of an enamel mixture (including glass frits and pigment frits, for example) on the MMC substrate and thermal treatment. As shown, a substantially consistent glass coating results, displaying rich, durable color. In particular, constituent materials for the enamel mixture are selected such that the CTE of the combination of frits is a substantial match to the CTE of the MMC substrate. Accordingly, the finished glass coating is less subject to delamination during cooling in comparison to other techniques.

The MMC substrate shown in FIGS. 5A and 5B can be used for consumer applications, such as mobile electronic devices. The capability to color parts of the device housing in a wide range of colors is an appealing prospect for manufacturers and consumers. The disclosed techniques and coatings can be used for consumer applications in which the aesthetics of the parts are an important feature.

Additionally, in some examples the glass enameling applied to the MMC housing provides a wear-resistant and/or corrosion-resistant coating, in addition to providing color.

Figure 6:
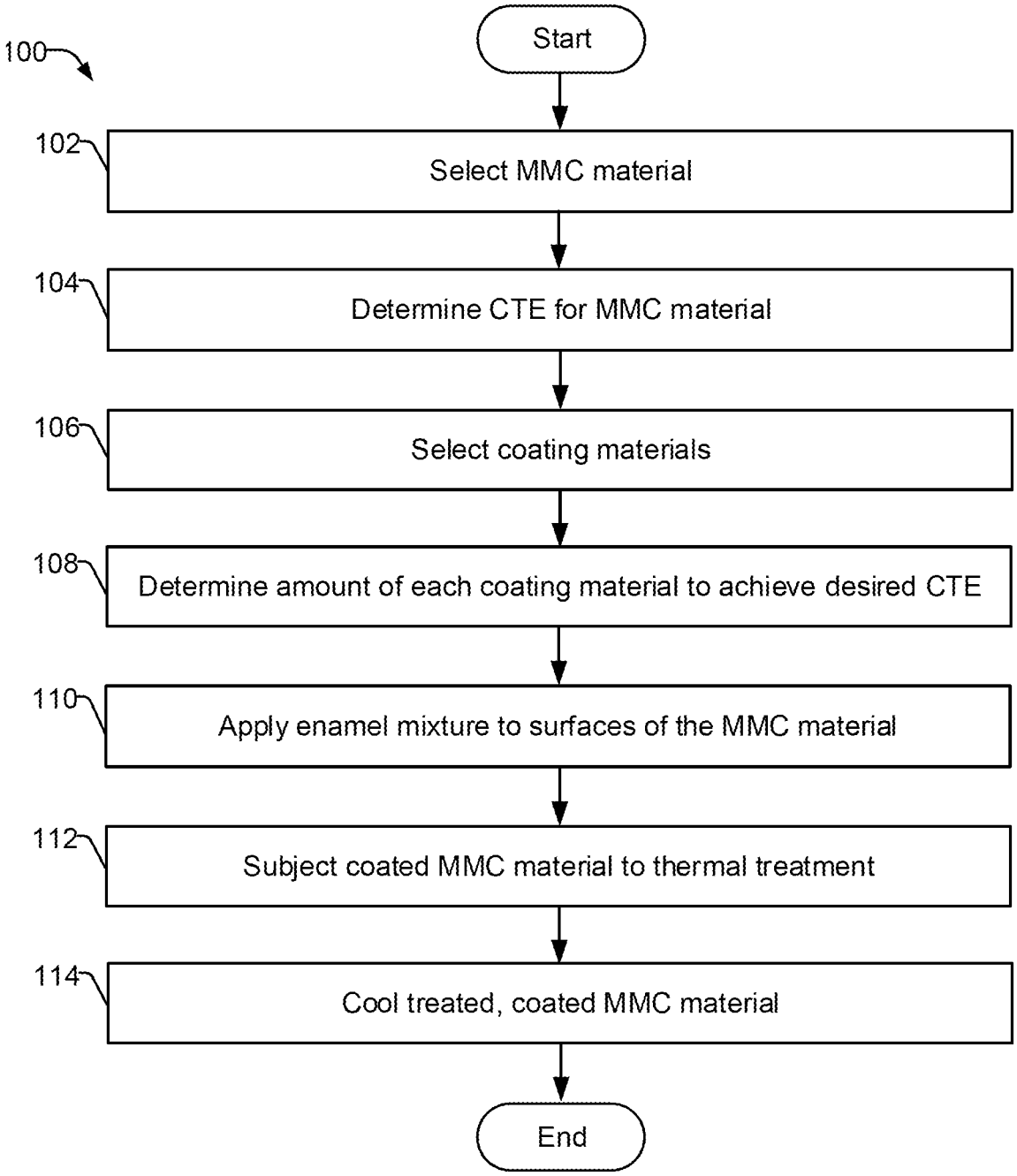
FIG. 6 is a flowchart representative of an example method 100 for enamel coating a MMC material, in accordance with aspects of the present disclosure.

FIG. 6 is a flowchart representative of an example method 100 for enamel coating a MMC material, in accordance with this disclosure. At block 102, a MMC material is selected (e.g., AlSiC-55p). At block 104, CTE for the selected MMC material is determined. At block 106, coating materials for an enamel mixture are selected. For example, the type of material (e.g., glass, pigment, etc.), are selected. In the absence of pigment frits, the glass frits alone produce a clear or translucent coating after the thermal treatment. However, by adding pigment frits to the enamel mixture, colored coatings can be achieved. Further, the coating materials (and enamel mixture) are selected to ensure that the firing temperature is below the solidus temperature of the MMC material to avoid damage to the MMC substrate.

At block 108, an amount of each of the coating materials is determined. For example, the CTE for the enamel mixture should be within a threshold range of the CTE for the selected MMC material. Thus, the amount of the coating materials (e.g., two or more, provided as multiple frits) are determined to result in a suitable CTE. At block 110, the enamel mixture (which may comprise the coating materials within a media, such as water), is applied to one or more surfaces of the MMC material.

At block 112, the coated MMC material is subjected to a thermal treatment to melt the enamel mixture. For example, the temperature, length of treatment time, and/or treatment environmental conditions can be determined, to achieve a desired result. As disclosed herein, the coated MMC material can be heated at temperatures up to 600 degrees C. between five and 20 minutes, or longer, in an ambient air environment. For instance, some enameled coatings benefit from longer heating times, thereby ensuring complete or nearly complete melting of the glass frits, creating better coloring. At block 114, the coated MMC material is cooled, thereby providing a durable, colored coating for the underlying material.

In some examples, the coated MMC material is subjected to one or more additional surface treatments to enhance the protective or aesthetic properties of the finished product.

In disclosed examples, a method of forming an enameled coating on a structure made of a metal matrix composite (MMC) material, the method including providing a structure formed of a MMC material; forming an enamel mixture having one or more glass materials and zero or more pigment materials; coating the enamel mixture on a surface of the MMC structure; heating the coated MMC structure to melt the enamel mixture; and cooling the heated, coated MMC structure to achieve a glass enameled coating.

In some examples, a MMC material of the MMC structure includes a first CTE. In examples, the glass material comprises a second CTE. The pigment material comprises a third CTE.

In examples, the method further includes selecting a ratio of the glass material to the pigment material to result in the enamel mixture having the first CTE. In examples, the method further includes selecting the MMC material from Al/SiC or $Al/Al_2O_3$.

In some examples, forming the enamel mixture includes mixing glass frits of the glass material and pigment frits of the pigment material with a liquid media.

In some disclosed examples, a method of forming an enameled coating on a structure made of a metal matrix composite (MMC) material, the method including providing a structure formed of a MMC structure with a MMC material with a first coefficient of thermal expansion (CTE); forming an enamel mixture with a second CTE similar to the first CTE; coating the enamel mixture on a surface of the MMC structure; heating the coated MMC structure to melt the enamel mixture; and cooling the heated, coated MMC structure to achieve a glass enameled coating.

In some examples, a value of the second CTE is within 10% of a value of the first CTE. In examples, the enamel mixture comprises a glass material with a third CTE and a pigment material with a fourth CTE, the second CTE being different from the third and fourth CTE. In examples, the enamel mixture comprises approximately two thirds of the glass material and one third of the pigment material.

In some examples, the heating is performed in a furnace at a temperature of greater than 500 degrees C. In examples, the method further includes selecting the MMC material from Al/SiC or $Al/Al_2O_3$.

In some disclosed examples, a structure with an enameled coating is provided. The structure includes a structural frame formed of an MMC material containing a metal and a ceramic or organic compound; and an enameled coating on a surface of the MMC material, the enameled coating containing a coating material and a pigment material.

In some examples, the coating material is a glass or ceramic material and the pigment material is a colored dye. In examples, the MMC material has a first CTE, the enameled coating having a CTE substantially similar to the first CTE.

In some examples, the MMC material comprises Al/SiC or $Al/Al_2O_3$.

In examples, the Young's modulus value of the MMC material is greater than 125 GPa.

Without limitation, the following is a listing of specific advantages and features of the present disclosure.

In the drawings, similar features are denoted by the same reference signs throughout.

The foregoing description of preferred and other embodiments is not intended to limit or restrict the scope or applicability of the inventive concepts conceived of by the Applicants. It will be appreciated with the benefit of the present disclosure that features described above in accordance with any embodiment or aspect of the disclosed subject matter can be utilized, either alone or in combination, with any other described feature, in any other embodiment or aspect of the disclosed subject matter.

The invention claimed is:

1. A method comprising:

providing a structure formed of a metal matrix composite (MMC) material comprising a metal and a ceramic or organic material;

coating an enamel mixture on a surface of the structure;

heating the coated structure to melt the enamel mixture; and cooling the heated, coated structure to achieve an enameled coating on the surface of the structure, the enameled coating comprising a clear or translucent coating material and a pigment material that imparts the enameled coating with a color of the pigment material.

2. The method as defined in claim 1, further comprising selecting the MMC material of the structure with a first coefficient of thermal expansion (CTE).

3. The method as defined in claim 2, further comprising selecting a first glass material of the enamel mixture with a second CTE.

4. The method as defined in claim 3, further comprising selecting a second glass material of the enamel mixture with a third CTE.

5. The method as defined in claim 2, further comprising selecting a ratio of glass material and the pigment material of the enamel mixture to result in the enameled coating having the first CTE.

6. The method as defined in claim 1, further comprising selecting the MMC material from Al/SiC or $Al/Al_2O_3$.

7. The method as defined in claim 1, comprising mixing glass frits and pigment frits with a liquid media to form the enamel mixture.

8. A method comprising:

providing a structure formed of a metal matrix composite (MMC) material comprising a metal and a ceramic or organic compound, wherein the MMC material has a first coefficient of thermal expansion (CTE);

forming an enamel mixture with a second CTE substantially similar to the first CTE;

coating the enamel mixture on a surface of the structure;

heating the coated structure to melt the enamel mixture; and cooling the heated, coated structure to achieve an enameled coating on the surface of the MMC material, the enameled coating comprising a clear or translucent coating material and a pigment material that imparts the enameled coating with a color of the pigment material.

9. The method as defined in claim 8, wherein a value of the second CTE is within 10% of a value of the first CTE.

10. The method as defined in claim 8, wherein:

the clear or translucent coating material has a third CTE;

the pigment material has a fourth CTE; and the second CTE is different from the third and fourth CTE.

11. The method as defined in claim 8, wherein the enamel mixture comprises approximately two thirds of one glass frit material and one third of another glass frit material.

12. The method as defined in claim 8, wherein the heating is performed at a temperature of greater than 500 degrees C.

13. The method as defined in claim 8, further comprising selecting the MMC material from Al/SiC or $Al/Al_2O_3$.

14. A structure, comprising:

a structural frame formed of a metal matrix composite (MMC) material comprising a metal and a ceramic or organic compound; and an enameled coating on a surface of the MMC material, the enameled coating comprising a clear or translucent coating material and a pigment material that imparts the enameled coating with a color of the pigment material.

15. The structure as defined in claim 14, wherein the structure is a housing for an electronic consumer device.

16. The structure as defined in claim 15, wherein;

the clear or translucent coating material is a glass or ceramic material; and the pigment material is selected from a variety of different colored pigment materials, each of which is capable of imparting the enameled coating with its respective color.

17. The structure as defined in claim 15, wherein the MMC material has a first coefficient of thermal expansion (CTE), the enameled coating having a CTE substantially similar to the first CTE.

18. The structure as defined in claim 15, wherein the MMC material comprises one or more of aluminum or an aluminum alloy.

19. The structure as defined in claim 18, wherein the MMC material comprises Al/SiC or $Al/Al_2O_3$.

20. The structure as defined in claim 15, wherein the Young's modulus value of the MMC material is greater than 125 GPa.

* * * * *